US007331373B2

(12) United States Patent
DasGupta et al.

(10) Patent No.: US 7,331,373 B2
(45) **Date of Patent: *Feb. 19, 2008**

(54) SEMI-SOLID AND SQUEEZE CASTING PROCESS

(75) Inventors: Rathindra DasGupta, Portage, MI (US); Robert Hollacher, St. Joseph, MI (US); Mark Musser, Osceola, IN (US); Yun Xia, Portage, MI (US); Richard Brian Szymanowski, St. Joseph, MI (US)

(73) Assignees: Contech U.S., LLC, Wilmington, DE (US); Contech Operating UK, Ltd., Welshpool, Powys (GB)

( * ) Notice: Subject to any disclaimer, the term of this patent is extended or adjusted under 35 U.S.C. 154(b) by 0 days.

This patent is subject to a terminal disclaimer.

(21) Appl. No.: 11/366,513

(22) Filed: Mar. 3, 2006

(65) Prior Publication Data

US 2006/0213633 A1 Sep. 28, 2006

Related U.S. Application Data

(63) Continuation-in-part of application No. 11/035,062, filed on Jan. 14, 2005, now abandoned.

(51) Int. Cl.
*B22D 17/12* (2006.01)

(52) U.S. Cl. ..... 164/113

(58) Field of Classification Search ..... 164/113, 164/900

See application file for complete search history.

(56) References Cited

U.S. PATENT DOCUMENTS 5,263,531 A 11/1993 Drury et al.
5,429,175 A 7/1995 Thieman et al. ..... 164/312
5,660,223 A 8/1997 Thieman et al. ..... 164/314
5,911,843 A 6/1999 Bergsma ..... 148/550
6,382,302 B1 * 5/2002 Imwinkelried ..... 164/312

(Continued)

FOREIGN PATENT DOCUMENTS

EP 0315801 5/1989

(Continued)

OTHER PUBLICATIONS

Vinarcik "High Integrity Die Casting Processes", 2003, John Wiley, New York, XP-002303487, pp. 67-84.

(Continued)

*Primary Examiner*—Kevin P. Kerns
(74) *Attorney, Agent, or Firm*—Baker & Hostetler LLP

(57) ABSTRACT

A method of making a cast product, includes heating an alloy to a temperature between about 1210 and 1470° F. so that the alloy is in a liquid state, injecting the alloy into a vertical die casting machine cavity, injecting the alloy into a mold having a gated configuration, wherein the injecting further comprises a shot velocity between 3-8 inches per second and a pressure between 5,000 and 14,000 psi, cooling the alloy in the mold, and forming the cast product, wherein the cast product is selected from a group consisting of suspension components, knuckles, control arms, transmission input housings, bed plates, swash plates, air conditioning compressor pistons, engine valve bodies, engine bed plates, transmission valve bodies, master cylinders, brake calipers, ABS braking components, shock mounts, engine bedplates, engine valve bodies and pump housings.

25 Claims, 3 Drawing Sheets

U.S. PATENT DOCUMENTS

| | | | | |
|---|---|---|---|---|
| 7,165,598 | B2 * | 1/2007 | DasGupta | 164/113 |
| 2003/0141033 | A1 | 7/2003 | Kamm et al. | 164/80 |
| 2004/0094286 | A1 | 5/2004 | Kamm et al. | 164/113 |
| 2005/0199363 | A1 | 9/2005 | DasGupta | |

FOREIGN PATENT DOCUMENTS

| | | |
|---|---|---|
| WO | WO 02/16062 A1 | 2/2002 |
| WO | 03/064075 | 8/2003 |
| WO | WO 2005/032746 A1 | 4/2005 |

OTHER PUBLICATIONS

J.L. Jorstad, "Processing of SSM: Practical Considerations", Science and Technology of Semi-Solid Metal Processing, Oct. 2001, XP-002966510, pp. 1-30.

J.L. Jorstad, "Sub-Liquidus Casting: Process Concept & Product Properties", American Foundry Society, 107th Casting Congress, Apr. 26-29, 2003, Milwaukee WI, USA., pp. 1-43.

* cited by examiner

SEMI-SOLID AND SQUEEZE CASTING PROCESS

CROSS-REFERENCE TO RELATED APPLICATIONS

This application claims priority to and is a continuation-in-part, of U.S. patent application entitled, SEMI-SOLID METAL CASTING PROCESS, filed Jan. 14, 2005, having a Ser. No. 11/035,062, now abandoned, which claims priority to U.S. patent application entitled, SEMI-SOLID METAL CASTING PROCESS, filed Sep. 29, 2003, having a Ser. No. 10/671,707, now abandoned, the disclosure of which are hereby incorporated by reference in its entirety.

FIELD OF THE INVENTION

The present invention relates generally to the field of processes for casting metal alloys. More particularly, the present invention relates to a process and apparatus for semi-solid and molten metal casting of metal alloys.

BACKGROUND OF THE INVENTION

Regular casting methods such as conventional die casting, gravity permanent mold casting, and squeeze casting have long been used for metals and their alloys. However, these current processes when used to manufacture parts with relatively complex geometries often yield products with undesirable shrink porosity, which can adversely impact the quality and integrity of the part. Shrink porosity defines a condition that arises as a metal part begins to shrink as it cools and solidifies along the outer surface, leaving pockets of air (referred to as "voids") trapped in the center of the part. If the voids are not reconstituted with metal, the cast part is termed "porous." Particularly in the design of complex parts, such as, for example, automotive transmission valve bodies or engine bedplates, the greatest shrink porosity is found in the thicker areas.

One method of reducing shrink porosity is to cast semi-solid metal (SSM) instead of liquid molten metal. SSM casting, which generally involves low temperature, low velocity, and less turbulent injection of metal, typically reduces the occurrence of shrink porosity. Where SSM casting of metal materials has been involved however, the conventional methods have not been employed successfully to date. Rheocasting and thixocasting are casting methods that were developed in an attempt to convert conventional casting means to SSM casting, but these SSM methods require costly retrofitting to conventional casting machinery and attempts at conventional casting of SSM have been unsuccessful.

Another method to reduce porosity levels is to apply a direct-feed system. The direct-feed system allows molten metal to continue to feed directly into the areas of thick geometry during solidification, thereby filling the air pockets with metal as they form. In this way, shrink porosity can be significantly reduced in those areas. Preferably, the direct feed can be localized to multiple areas within particularly complex parts or as required.

Accordingly, it is desirable to provide a method of casting SSM metals and molten metals and alloys utilizing conventional and/or rheocasting die casting devices that can impart desirable mechanical properties. It is further desirable to provide a process to control the shrink porosity of cast parts at multiple locations throughout a part. Further still, it is desirable to provide a method of producing products with metal alloy castings wherein the temperature of the semi-solid metal slurry and molten metal can be controlled.

SUMMARY OF THE INVENTION

The foregoing needs are met, to an extent, by the present invention, wherein in one embodiment a process and an apparatus is provided that enables the use of conventional die casting machinery in SSM casting and molten metal squeeze casting.

In an embodiment of the present invention, a method of making a cast product, includes heating an alloy to a temperature between about 1210 and 1470° F. so that the alloy is in a liquid state, injecting the alloy into a vertical die casting machine cavity, injecting the alloy into a mold having a gated configuration, wherein the injecting further comprises a shot velocity between 3-8 inches per second and a pressure between 5,000 and 14,000 psi, cooling the alloy in the mold, and forming the cast product, wherein the cast product is selected from a group consisting of suspension components, knuckles, control arms, and transmission input housings.

In another embodiment of the present invention, a method of making a cast product, includes heating an alloy to a temperature between about 1210 and 1470° F. so that the alloy is in a liquid state, injecting the alloy into a vertical die casting machine cavity, injecting the alloy into a mold having a gated configuration, wherein the injecting further comprises a shot velocity between 3-8 inches per second and a pressure between 5,000 and 14,000 psi, cooling the alloy in the mold, and forming the cast product, wherein the cast product is selected bed plates, swash plates, and air conditioning compressor pistons.

In yet another embodiment of the present invention, a method of making a cast product, includes heating an alloy to a temperature between about 1210 and 1470° F. so that the alloy is in a liquid state, injecting the alloy into a vertical die casting machine cavity, injecting the alloy into a mold having a gated configuration, wherein the injecting further comprises a shot velocity between 3-8 inches per second and a pressure between 5,000 and 14,000 psi, cooling the alloy in the mold, and forming the cast product, wherein the cast product is selected from a group consisting of engine valve bodies, engine bed plates, and transmission valve bodies.

In still another embodiment of the present invention, a method of making a cast product, includes heating an alloy to a temperature between about 1210 and 1470° F. so that the alloy is in a liquid state, injecting the alloy into a vertical die casting machine cavity, injecting the alloy into a mold having a gated configuration, wherein the injecting further comprises a shot velocity between 3-8 inches per second and a pressure between 5,000 and 14,000 psi, cooling the alloy in the mold, and forming the cast product, wherein the cast product is selected master cylinders, brake calipers, and ABS braking components.

In another embodiment of the present invention, a method of making a cast product, includes heating an alloy to a temperature between about 1210 and 1470° F. so that the alloy is in a liquid state, injecting the alloy into a vertical die casting machine cavity, injecting the alloy into a mold having a gated configuration, wherein the injecting further comprises a shot velocity between 3-8 inches per second and a pressure between 5,000 and 14,000 psi, cooling the alloy in the mold, and forming the cast product, wherein the cast product is selected from a group consisting of shock mounts, engine bedplates, engine valve bodies and pump housings.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
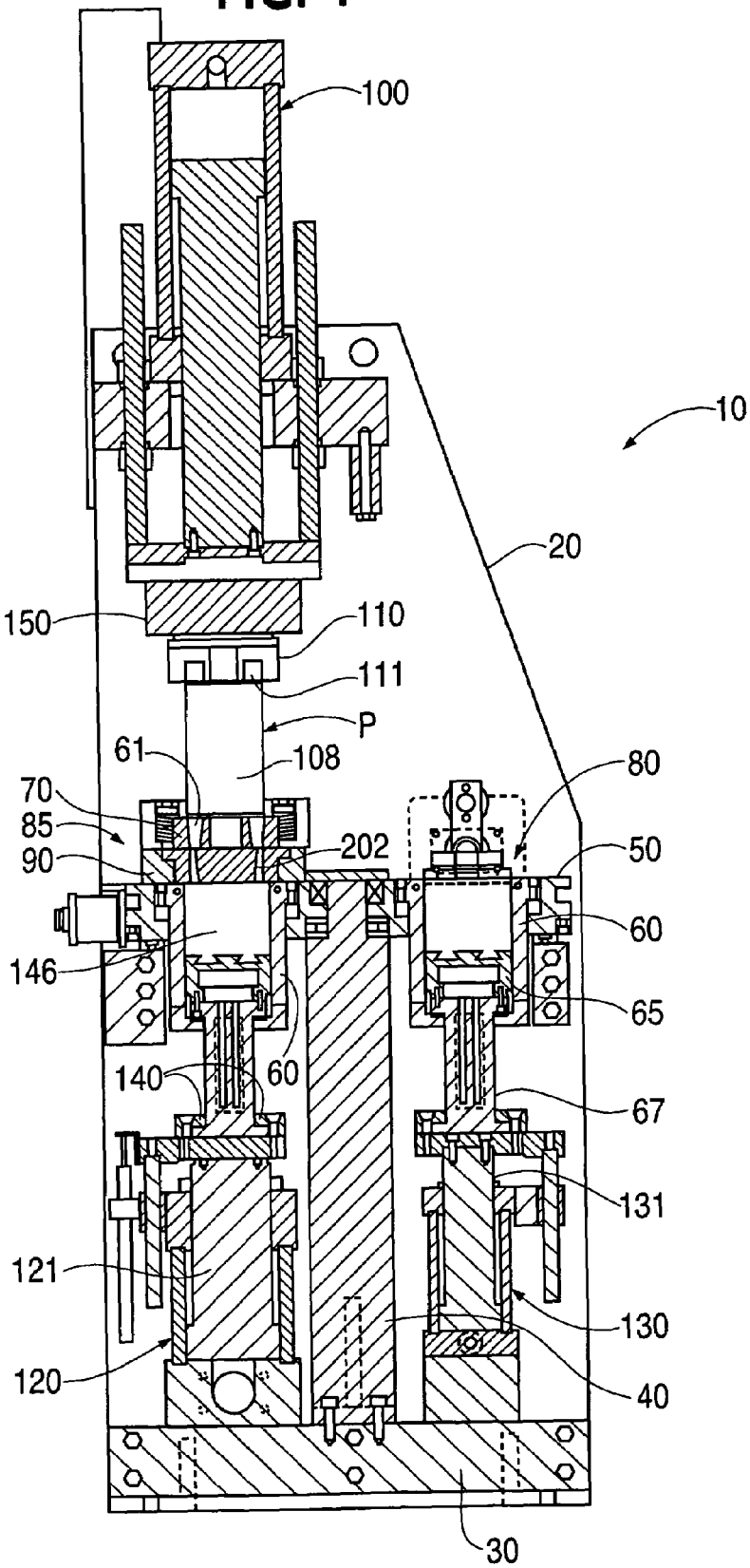
FIG. 1 illustrates a cross section of an exemplary vertical die casting press of a type suitable for carrying out the functions of an embodiment of the invention.

The invention will now be described with reference to the drawing figures, in which like reference numerals refer to like parts throughout. An embodiment in accordance with the present invention provides a method of SSM casting without the need for retrofitting of conventional casting equipment. Moreover, other embodiments of the instant invention provide a direct-feed semi-solid casting process.

In one embodiment, vertical die casting machines or presses of the general type disclosed in U.S. Pat. Nos. 5,660,233 and 5,429,175, assigned to and commercially available from THT Presses, Inc., Dayton, Ohio, are desirable. The THT presses such as a 200 Ton Indexing Shot Machine, a 1000 Ton Shuttle Machine or a 100 Ton Shuttle Machine, in particular, are capable of operating at a higher speed and with a shorter cycle time than previously known die casting presses and which, as a result, produce higher quality parts without porosity. The die casting presses are also simpler and less expensive in construction, requiring less maintenance and therefore more convenient to service. Any type of vertical die casting machine, any brand or size may be used with the currently disclosed process. Further, the machines may include gates, or mechanisms whereby a metal is fed directly into the thick areas of the cast part.

One of ordinary skill in the art will appreciate from the descriptions herein, that some or all of the features of the presses of the instant invention may differ to some extent from those specified below depending on the specific press, but that variations are to be expected and are within the scope and spirit of the present invention. By way of example, the THT presses of this invention may be classified as "indexing-type" or "shuttle-type." Though the indexing press will be detailed in an embodiment below, both types of presses may be used in the instant invention.

Referring now to FIG. 1 in accordance with one embodiment of the present invention, a vertical die casting press 10 includes a frame 20 having a base 30 supporting a vertical pedestal 40 or post on which is mounted to a rotary indexing table 50. The table 50 supports a pair of diametrically opposite shot sleeves 60 each of which receives a shot piston 65 connected to a downwardly projecting piston rod 67. A gate plate 90 extends horizontally between the side walls of the frame 20 and above the indexing table 50 for supporting a lower mold 70 section defining a cavity 61. When the table 50 is indexed in steps of 180 degrees, the shot sleeves 60 are alternately located at a metal receiving or pour station 80 and a metal injecting or transfer station 85 under the gate plate 90. A hydraulic clamping cylinder 100 is supported by the frame 20 above the transfer station 85 and moves an upper mold 110 section vertically above the lower mold 70 section.

A high pressure hydraulic shot cylinder 120 is mounted on the base 30 under the transfer station 85, and a substantially smaller hydraulic ejection cylinder 130 is mounted on the base 30 under the metal receiving or pour station 80. Each of the hydraulic cylinders 120 and 130 has a non-rotating vertical piston rod 121 and 131, respectively, which carries a set of spaced coupling plates 140. Each set of plates 140 defines laterally extending and opposing undercut grooves for slidably receiving an outwardly projecting bottom flange on each of the shot piston rods. Thus, when the rotary table 50 is indexed, the shot piston rods rotate with the shot sleeves 60 and alternately engage the piston rods of the two fixed hydraulic shot 120 and ejection cylinders 130.

The upper platen moves downwardly to close and clamp the upper mold 110 against the lower mold 70 or against a cavity defining part P confined between the upper and lower molds 110 and 70. The hydraulic shot cylinder 120 is actuated for transferring the molten metal from each shot cylinder 60 upwardly into the cavity 61 defined by the clamped mold sections 70 and 110. The cavity 61 is evacuated, and the shot piston 65 is forced upwardly to inject the molten metal into the mold cavity or cavities. The molds 70 and 110 and the shot piston 65 are then cooled, optionally by circulating water through passages within the molds and shot piston, to solidify the die cast material. The shot cylinder 120 then retracts connected sprues 150 or biscuit downwardly into the shot sleeve 60 after the metal has partially solidified within the gate plate 90. After the table 50 is indexed 180 degrees, the smaller hydraulic ejection cylinder 130 is actuated for ejecting the biscuit upwardly to the top of the indexing table 50 where the biscuit is discharged. The cycle is then repeated for die casting another part or set of parts.

In operation of the vertical die casting machine or press described above in connection with FIG. 1, a predetermined charge or shot of molten metal is poured into the shot sleeve 60 in the pour station 80. The shot sleeves 60 can be equipped with heaters and temperature sensors to heat and or cool the metal as is desirable at any time, including the period while table 50 indexes 180 degrees. The lateral transfer of the molten metal and the upward injection of the metal into the mold cavities are also effective to degas the molten metal, thereby minimizing porosity of the solidified die cast parts. Preferably, a light suction is applied to cavities 108 and runner 202 and an injecting chamber 146 to remove air from the chamber and to remove the gas separated from the molten metal within the shot cylinder.

Figure 2:
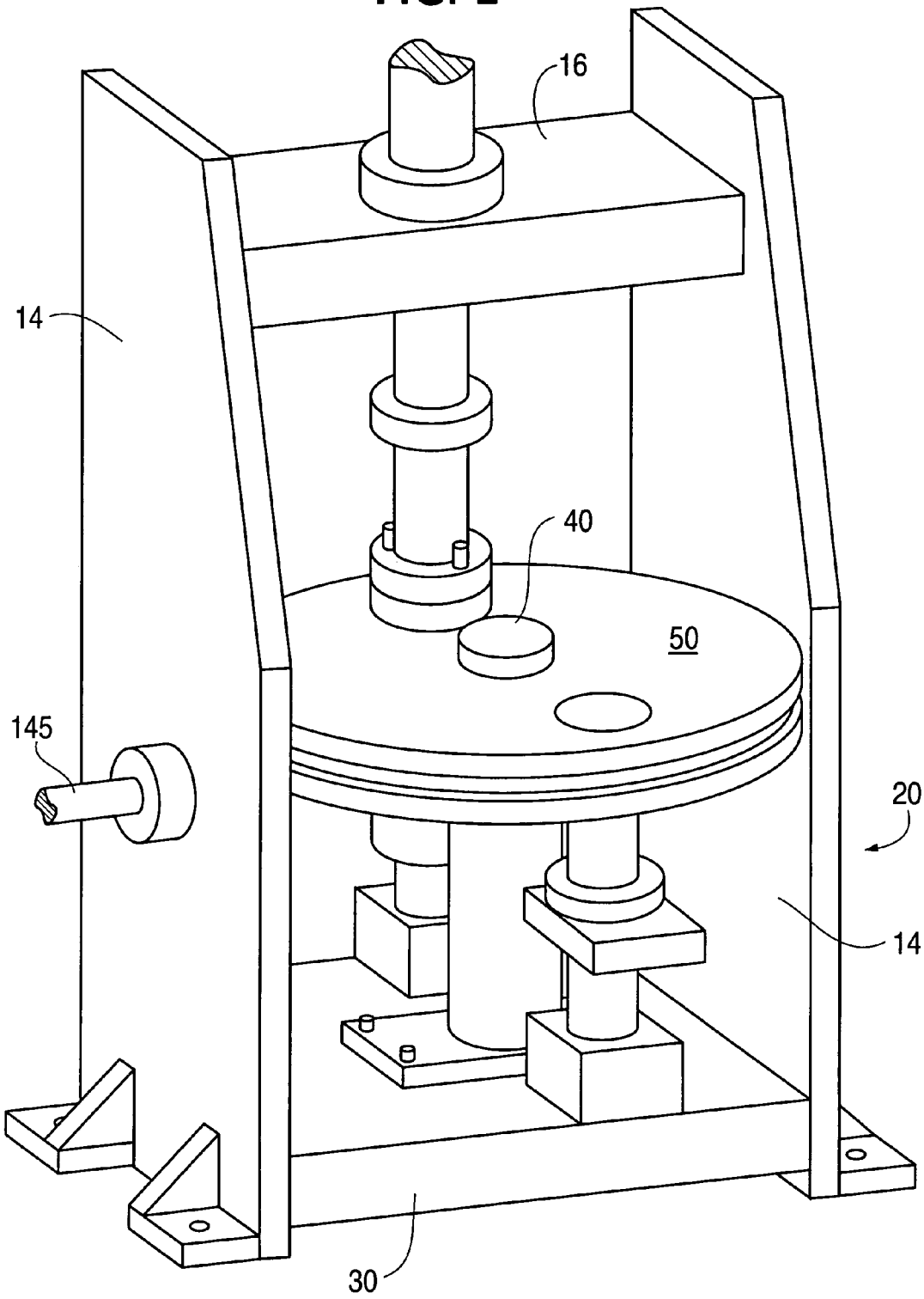
FIG. 2 is a perspective view of an exemplary vertical die casting press of a type suitable for carrying out the functions of an embodiment of the invention.

FIG. 2 is a perspective view of an exemplary vertical die casting press 10 of a type suitable for carrying out the functions of an embodiment of the invention. The frame 20 is formed by two parallel vertical sidewalls 14. The two sidewalls are connected by a horizontal top plate 16. A double acting fluid or air cylinder 145 is used to discard the waste material or biscuit that is formed during the die casting process. The fluid cylinder 145 transfers the biscuit to a container (not shown).

It has now been found that the above described press can also be used for SSM casting as well as for molten metal squeeze casting. The use of metal slurry over molten metal reduces fluid turbulence when injected into the die, which also reduces the amount of air that may be trapped in the final casted part. Less air in the final part lends greater mechanical integrity and allows cast products to be heat treated. In addition, metals used in SSM casting require less heat thereby reducing cost and improving longevity of the molds and dies.

Without being limited to or bound by theory, the microstructure of SSM cast products can determine the mechanical properties of the product. Moreover, it is understood by those of ordinary skill in the art that the microstructure can be manipulated prior to casting. One way to manipulate the final microstructure of an SSM cast part is to control, thereby reduce, the time the metal remains in the SSM range. The presses described above afford such an opportunity. Specifically, the indexing time (i.e., the delay between indexing between the pour station 80 and transfer station 85) can be used to control the time the molten metal is cooled in the shot sleeve to reach the SSM range. That is, the amount of time the metal spends in the shot sleeve before it is injected into the molds can be regulated or optimized for a desirable microstructure. Alternatively, molten metal at a predetermined temperature may be poured into the shot sleeve of shuttle presses, i.e. presses that lack the indexing feature.

Many metals and alloys known in the art can be used for SSM casting and can be employed with the squeeze casting. In some embodiments aluminum-silicon alloys can be used. By definition, aluminum alloys with up to but less than about 11.7 weight percent Si are defined "hypoeutectic," whereas those with greater than about 11.7 weight percent Si are defined "hypereutectic." In all instances, the term "about" has been incorporated in this disclosure to account for the inherent inaccuracies associated with measuring chemical weights and measurements known and present in the art. In yet other embodiments, aluminum-silicon copper alloys and/or aluminum-copper alloys may be used with the present invention.

Preferably, the metal to be cast is heated in a range from about 10° C. to about 15° C. above the liquids temperature (i.e., the semi-solid temperature). For Al—Si alloys this generally ranges from about 585° C. to about 590° C. The melt temperature is then allowed to cool to form a semi-solid slurry before it is finally cast.

In one embodiment, a 380 alloy, (Al—Si—Cu alloy commonly used in the art) is heated to 590 to 595° C. Once heated to the desired temperature, the metal is then transferred to the shot sleeve 60 in the pour station 85. The metal is then indexed to the transfer station 80, taking about 2 seconds. During that period, the metal is cooled to between 585° C. and 590° C. before being cast.

The optimal transfer time from the pour station 80 to transfer station 85 can be experimentally determined and will vary depending on the metal or alloy being cast. Generally, for Al—Si alloys, a transfer time ranging from about 0.5 seconds to about 5 seconds is preferred. In other embodiments, the time may range from about 1 second to about 30 seconds.

Figure 3:
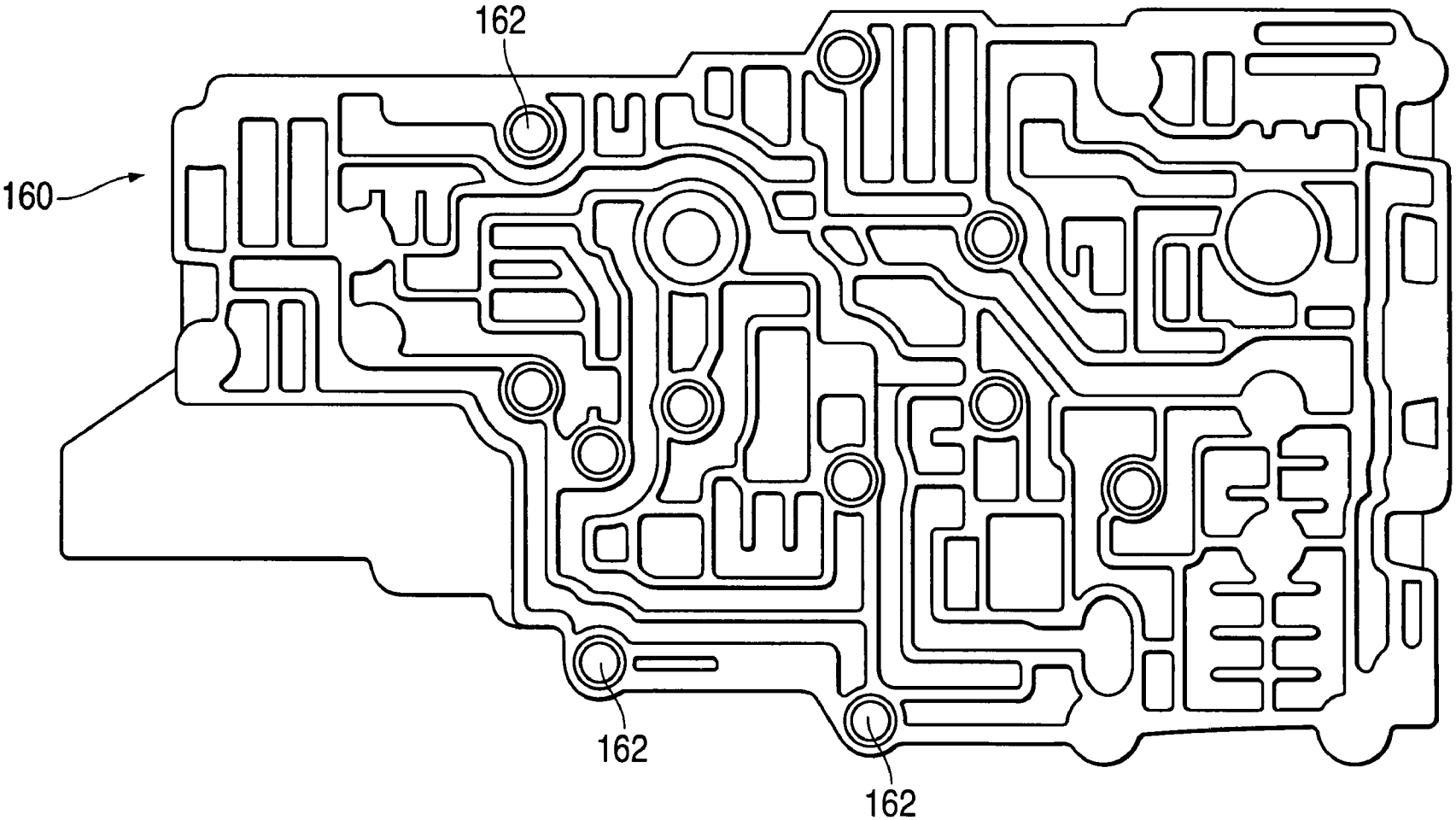
FIG. 3 exemplifies a transmission valve body mold that couples with a gate plate that may be used in accordance with the invention.

FIG. 3 exemplifies a transmission valve body mold 160 that couples with a gate plate that may be used in accordance with the invention. The gate plate (not shown) connects to the transmission valve body mold 160 by way of the numerous openings 162 on the transmission valve body mold 160, allowing for the introduction of the molten metal through the openings 162 into the transmission valve body mold 160.

As mentioned above, gated plates allow for direct feed of metal to multiple locations within a part simultaneously. Especially true in complex parts, direct feed enables metal to be selectively injected into specific locations within a part as the part cools. As a part cools and contracts along the edges, voids emerge within the center or thicker portions of a cast product. With gated plates, however, the potential voids may be continually supplied with metal so as to reduce the likelihood of their emergence and thereby reduce porosity.

The present invention may be applied to cast a variety of parts known in the art and all such applications are within the scope of the present invention. In an embodiment of the present invention, the die cast process described herein is used to cast parts with relatively complex geometries. Such parts may include automotive parts, for example, suspension components including knuckles and control arms, bed plates, swashplates, air conditioning compressor pistons, engine valve bodies, transmission valve bodies and pump housings.

The present invention may be preferably suited for complex parts in that the presses described herein have a smaller ratio of upper die to lower die parting position than found in conventional die casting presses which can reduce the gas content in the part. Also, where in conventional die casting processes the dwell time is controlled by biscuit thickness, the ingate controls dwell time in the present invention. The smaller ingates have smaller volumes to be cooled, and thereby solidification time is reduced. The casting process described herein also requires less clamping force than required by other casting processes such as with high pressure die casting and/or squeeze casting. Moreover, the present invention employs a large number of cavities which allows for more parts to be produced per given amount of time.

Although, there are advantages in using SSM, there are other instances where using molten metal squeeze casting is desirable. Squeeze casting is a process whereby molten metal enters a die and as the molten metal begins filling up the die, the molten metal begins to solidify and shrink. As the molten metal begins to solidify and shrink, additional molten metal is injected to fill in voids created by the shrinkage. Pressure is also continually maintained.

Thus, additional molten material and pressure are maintained to reduce the shrinkage that occurs. The amount of pressure and the duration of pressure are higher and longer, respectively, with molten metal squeeze casting than with conventional die casting. Rapid heat removal provides equiaxed, fine grain structure.

With squeeze casting, there is the flexibility in that nearly any alloy that can be melted may be cast. The ability to use a greater variety of metals and alloys is desirable, particularly magnesium and aluminum alloys. It should also be noted that both hypoeutectic and hypereutectic AlSi alloys may be used for squeeze casting.

Squeeze casting exhibits a dendritic microstructure and also produces high yield strength and high tensile strength. Components are produced by introducing liquid metal into dies and holding it under very high pressures. The castings thus produced, exhibit remarkable physical properties, are of excellent surface finish and have accurate dimensions. They are also easily machinable.

Squeeze casting produces very low gas entrapment and castings exhibit shrinkage volumes approximately less than half those seen in other types of castings. The process produces the high quality surfaces typical of metal mold casting, with good reproduction of detail. Rapid solidification results in a fine grain size, which improves mechanical properties. Therefore, all the parts discussed herein may alternately be made using squeeze casting.

In addition to the parts mentioned previously, squeeze casting or SSM may be used to produce master cylinders, brake calipers, ABS braking components, shock mounts, engine bedplates, engine valve bodies and transmission input housings.

Example process parameters include the following: Example 1: Parts may be produced from an AlSiCu alloy with silicon content approximately that of the eutectic composition. In this instance, the metal temperature may range between 1210 and 1250° F. and the shot velocity may range between 3-8 inches per second ("ips"), preferably between 5-6 ips. Further, the cavity pressure may range between 10,000 and 12,000 psi.

Example 2: Parts may be produced from a hypoeutectic Al—Si alloy where the metal temperature ranges between 1280 and 1320° F. The shot velocity range may be between 3-8 ips, preferably 5-6 ips and the cavity pressure may range between 10,000-14,000 psi.

Example 3: Parts may be produced from a hypoeutectic Al—Si alloy where the metal temperature ranges between 1360 and 1390° F. The shot velocity range may range between 3-8 ips, preferably 5-6 ips and the cavity pressure may range between 5,000 and 8,000 psi.

Example 4: Parts may be produced from a hypereutectic Al—Si alloy with silicon content exceeding 16%. In this instance, the metal temperature may range between 1430 and 1470° F. and have a shot velocity of 3-8 ips, preferably 5-6 ips. Further, the cavity pressure may range between 7,000 and 10,000 psi.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method of making a cast product, comprising:

heating an alloy to a temperature between about 1210 and 1470° F. so that the alloy is in a liquid state;

injecting the alloy into a vertical die casting machine cavity;

injecting the alloy into a mold having a gated configuration, wherein the injecting further comprises a shot velocity between 3-8 inches per second and a pressure between 5,000 and 14,000 psi;

cooling the alloy in the mold; and forming the cast product, wherein the cast product is selected from a group consisting of suspension components, knuckles, control arms, and transmission input housings.

2. The method of claim 1, wherein the alloy is AlSiCu.

3. The method of claim 2, wherein the alloy is a hypoeutectic AlSi alloy.

4. The method of claim 2, wherein the alloy is a hypereutectic AlSi alloy.

5. The method of claim 2, wherein the gated configuration is a gate plate.

6. A method of making a cast product, comprising:

heating an alloy to a temperature between about 1210 and 1470° F. so that the alloy is in a liquid state;

injecting the alloy into a vertical die casting machine cavity;

injecting the alloy into a mold having a gated configuration, wherein the injecting further comprises a shot velocity between 3-8 inches per second and a pressure between 5,000 and 14,000 psi;

cooling the alloy in the mold; and forming the cast product, wherein the cast product is selected from a group consisting of bed plates, swash plates, and air conditioning compressor pistons.

7. The method of claim 6, wherein the alloy is AlSiCu.

8. The method of claim 6, wherein the alloy is a hypoeutectic AlSi alloy.

9. The method of claim 6, wherein the alloy is a hypereutectic AlSi alloy.

10. The method of claim 6, wherein the temperature is between about 1210 and 1250° F.

11. A method of making a cast product, comprising:

heating an alloy to a temperature between about 1210 and 1470° F. so that the alloy is in a liquid state;

injecting the alloy into a vertical die casting machine cavity;

injecting the alloy into a mold having a gated configuration, wherein the injecting further comprises a shot velocity between 3-8 inches per second and a pressure between 5,000 and 14,000 psi;

cooling the alloy in the mold; and forming the cast product, wherein the cast product is selected from a group consisting of engine valve bodies, engine bed plates, and transmission valve bodies.

12. The method of claim 11, wherein the alloy is AlSiCu.

13. The method of claim 11, wherein the alloy is a hypoeutectic AlSi alloy.

14. The method of claim 11, wherein the alloy is a hypereutectic AlSi alloy.

15. The method of claim 11, wherein the temperature is between about 1360 and 1390° F.

16. A method of making a cast product, comprising:

heating an alloy to a temperature between about 1210 and 1470° F. so that the alloy is in a liquid state;

injecting the alloy into a vertical die casting machine cavity;

injecting the alloy into a mold having a gated configuration, wherein the injecting further comprises a shot velocity between 3-8 inches per second and a pressure between 5,000 and 14,000 psi;

cooling the alloy in the mold; and forming the cast product, wherein the cast product is selected from a group consisting of master cylinders, brake calipers, and ABS braking components.

17. The method of claim 16, wherein the alloy is AlSiCu.

18. The method of claim 16, wherein the alloy is a hypoeutectic AlSi alloy.

19. The method of claim 16, wherein the alloy is a hypereutectic AlSi alloy.

20. The method of claim 16, wherein the pressure is between about 5,000 and 8,000 psi.

21. A method of making a cast product, comprising:

heating an alloy to a temperature between about 1210 and 1470° F. so that the alloy is in a liquid state;

injecting the alloy into a vertical die casting machine cavity;

injecting the alloy into a mold having a gated configuration, wherein the injecting further comprises a shot velocity between 3-8 inches per second and a pressure between 5,000 and 14,000 psi;

cooling the alloy in the mold; and forming the cast product, wherein the cast product is selected from a group consisting of shock mounts, engine bedplates, engine valve bodies and pump housings.

22. The method of claim 21, wherein the alloy is AlSiCu.

23. The method of claim 21, wherein the alloy is a hypoeutectic AlSi alloy.

24. The method of claim 21, wherein the alloy is a hypereutectic AlSi alloy.

25. The method of claim 21, wherein the pressure is between about 10,000 and 14,000 psi.

* * * * *